US007882947B2

(12) United States Patent
Evans et al.

(10) Patent No.: US 7,882,947 B2
(45) Date of Patent: Feb. 8, 2011

(54) PARTIALLY CUT LOOSEFILL PACKAGE

(75) Inventors: Michael E. Evans, Granville, OH (US); Todd M. Jenkins, Newark, OH (US); Timothy D. Schoenenberger, Granville, OH (US); Brian K. Linstedt, Ostrander, OH (US); Hugo E. Ecoles, New York City, NY (US); John B. Younger, Columbus, OH (US); Joseph M. Sexton, Dublin, OH (US); Jeffrey D. Accursi, Columbus, OH (US); Christopher H. Kujawski, Columbus, OH (US); Robert O'Grady, Columbus, OH (US)

(73) Assignee: Owens Corning Intellectual Capital, LLC, Toledo, OH (US)

( * ) Notice: Subject to any disclaimer, the term of this patent is extended or adjusted under 35 U.S.C. 154(b) by 1123 days.

(21) Appl. No.: 11/581,522

(22) Filed: Oct. 16, 2006

(65) Prior Publication Data

US 2008/0087557 A1 Apr. 17, 2008
US 2009/0173645 A2 Jul. 9, 2009

(51) Int. Cl.
*B65D 71/00* (2006.01)

(52) U.S. Cl. ..... 206/321; 206/388; 206/83.5

(58) Field of Classification Search ..... 206/321, 206/825, 388, 83.5
See application file for complete search history.

(56) References Cited

U.S. PATENT DOCUMENTS

| | | | |
|---|---|---|---|
| 313,251 | A | 3/1885 | Taylor |
| 1,630,542 | A | 5/1927 | Schulz |
| 1,718,507 | A | 6/1929 | Wenzel et al. |
| 1,811,898 | A | 6/1931 | Schur et al. |
| 2,049,063 | A | 7/1936 | Hubbard |
| 2,057,121 | A | 10/1936 | Trevellyan |
| 2,057,122 | A | 10/1936 | Trevellyan |
| 2,193,849 | A | 3/1940 | Whitfield |
| 2,200,713 | A | 5/1940 | Ericson et al. |
| 2,235,542 | A | 3/1941 | Wenzel |
| 2,262,094 | A | 11/1941 | Burt |
| 2,273,962 | A | 2/1942 | Hubbard |
| 2,291,871 | A | 8/1942 | Bokum et al. |
| 2,308,197 | A | 1/1943 | Meyer |
| 2,311,773 | A | 2/1943 | Patterson |
| 2,355,358 | A | 8/1944 | Anderson |
| 2,404,678 | A | 7/1946 | Erb |

(Continued)

FOREIGN PATENT DOCUMENTS

| | | |
|---|---|---|
| DE | 3238492 | 4/1984 |

(Continued)

OTHER PUBLICATIONS

Hearing Testimony, Case No. 09 CV 263 Division 2, Boulder County District Court, Colorado, Apr. 28, 2009, 11 pages.

(Continued)

*Primary Examiner*—Jacob K Ackun, Jr.
(74) *Attorney, Agent, or Firm*—MacMillan, Sobanski & Todd, LLC

(57) ABSTRACT

A package of compressed blowing insulation includes a body of compressed blowing insulation, a bag encapsulating the body of compressed blowing insulation and a slit extending through the package to define a partially divided package.

13 Claims, 6 Drawing Sheets

U.S. PATENT DOCUMENTS 2,437,831 A 3/1948 Moore
2,532,318 A 12/1950 Mackey et al.
2,532,351 A 12/1950 Wedebrock
2,550,354 A 4/1951 Jacobsen
2,618,817 A 11/1952 Slayter
2,721,767 A 10/1955 Kropp
2,754,995 A 7/1956 Switzer
2,794,454 A 6/1957 Moulthrop
2,869,793 A 1/1959 Montgomery
2,938,651 A 5/1960 Specht et al.
2,964,896 A 12/1960 Finocchiaro
2,984,872 A 5/1961 France
2,989,252 A 6/1961 Babb
3,051,398 A 8/1962 Babb
3,076,659 A 2/1963 Kremer
3,175,866 A 3/1965 Nichol
3,231,105 A 1/1966 Easley
3,278,013 A 10/1966 Banks
3,314,732 A 4/1967 Hagan
3,399,931 A 9/1968 Vogt
3,403,942 A 10/1968 Farnworth
3,485,345 A 12/1969 Deasy
3,512,345 A 5/1970 Smith
3,556,355 A 1/1971 Ruiz
3,591,444 A 7/1971 Hoppe et al.
3,703,970 A 11/1972 Benson
3,747,743 A 7/1973 Hoffmann, Jr.
3,861,599 A 1/1975 Waggoner
3,869,337 A 3/1975 Hoppe et al.
3,895,745 A 7/1975 Hook
3,952,757 A 4/1976 Huey
3,995,775 A 12/1976 Birkmeier et al.
4,059,205 A 11/1977 Heyl
4,129,338 A 12/1978 Mudgett
4,134,508 A 1/1979 Burdett, Jr.
4,155,486 A 5/1979 Brown
4,179,043 A 12/1979 Fischer
4,180,188 A 12/1979 Anouma et al.
4,236,654 A 12/1980 Mello
4,268,205 A 5/1981 Vacca et al.
4,273,296 A 6/1981 Hoshall
4,337,902 A 7/1982 Markham
4,344,580 A 8/1982 Hoshall et al.
4,346,140 A 8/1982 Carlson et al.
4,365,762 A 12/1982 Hoshall
4,381,082 A 4/1983 Elliott et al.
4,411,390 A 10/1983 Woten
4,465,239 A 8/1984 Woten
4,536,121 A 8/1985 Stewart et al.
4,537,333 A 8/1985 Bjerregaard
4,560,307 A 12/1985 Deitesfeld
4,585,239 A 4/1986 Nicholson
4,640,082 A 2/1987 Gill
4,695,501 A 9/1987 Robinson
4,716,712 A 1/1988 Gill
4,784,298 A 11/1988 Heep et al.
4,880,150 A 11/1989 Navin et al.
4,915,265 A 4/1990 Heep et al.
4,919,403 A 4/1990 Bartholomew
4,978,252 A 12/1990 Sperber
5,014,885 A 5/1991 Heep et al.
5,037,014 A 8/1991 Bliss
5,052,288 A 10/1991 Marquez et al.
5,129,554 A 7/1992 Futamura
5,156,499 A 10/1992 Miklich
5,166,236 A 11/1992 Alexander et al.
5,289,982 A 3/1994 Andersen
5,303,672 A 4/1994 Morris
5,323,819 A 6/1994 Shade
5,368,311 A 11/1994 Heyl
5,380,094 A 1/1995 Schmidt et al.
5,392,964 A 2/1995 Stapp et al.
5,405,231 A 4/1995 Kronberg
5,472,305 A 12/1995 Ikeda et al.
5,511,730 A 4/1996 Miller et al.
5,590,984 A * 1/1997 Assarsson ..... 406/32
5,601,239 A 2/1997 Smith et al.
5,620,116 A 4/1997 Kluger et al.
5,624,742 A 4/1997 Babbitt et al.
5,639,033 A 6/1997 Miller et al.
5,642,601 A 7/1997 Thompson, Jr. et al.
5,647,696 A 7/1997 Sperber
5,683,810 A 11/1997 Babbitt et al.
5,819,991 A 10/1998 Khon et al.
5,829,649 A 11/1998 Horton
5,860,232 A 1/1999 Nathenson et al.
5,860,606 A 1/1999 Tiedeman et al.
5,927,558 A 7/1999 Bruce
5,934,809 A 8/1999 Marbler
5,987,833 A 11/1999 Heffelfinger et al.
5,997,220 A 12/1999 Wormser
6,004,023 A 12/1999 Koyanagi et al.
6,070,814 A 6/2000 Deitesfeld
6,074,795 A 6/2000 Watanabe et al.
6,109,488 A 8/2000 Horton
6,161,784 A 12/2000 Horton
6,209,724 B1 4/2001 Miller
6,266,843 B1 7/2001 Donan et al.
6,296,424 B1 10/2001 Ecket et al.
6,312,207 B1 11/2001 Rautiainen
6,503,026 B1 1/2003 Mitchell
6,510,945 B1 * 1/2003 Allwein et al. ..... 206/388
6,648,022 B2 11/2003 Pentz et al.
6,698,458 B1 3/2004 Sollars
6,779,691 B2 8/2004 Cheng
6,783,154 B2 8/2004 Persson et al.
6,796,748 B1 9/2004 Sperber
6,826,991 B1 12/2004 Rasmussen
7,284,715 B2 10/2007 Dziesinski et al.
7,354,466 B2 4/2008 Dunning et al.
2003/0075629 A1 4/2003 Lucas et al.
2003/0192589 A1 10/2003 Jennings
2003/0215165 A1 11/2003 Hogan et al.
2003/0234264 A1 12/2003 Landau
2004/0028847 A1 * 2/2004 Teague, III et al. ..... 428/34.1
2004/0124262 A1 7/2004 Bowman et al.
2005/0006508 A1 1/2005 Roberts
2005/0242221 A1 11/2005 Rota
2006/0024456 A1 * 2/2006 O'Leary et al. ..... 428/34.1
2006/0024457 A1 * 2/2006 O'Leary et al. ..... 428/34.1
2006/0024458 A1 * 2/2006 O'Leary et al. ..... 428/35.2
2006/0147660 A1 * 7/2006 O'Leary ..... 428/34.1
2006/0231651 A1 10/2006 Evans et al.
2007/0138211 A1 6/2007 O'Leary et al.
2008/0087751 A1 4/2008 Johnson et al.

FOREIGN PATENT DOCUMENTS

DE 3240126 5/1984
EP 0265751 4/1988
FR 2350450 3/1979
GB 1418882 12/1975
GB 1574027 9/1980
GB 2099776 12/1982
GB 2124194 2/1984
GB 2156303 10/1985
GB 2212471 7/1989
GB 2276147 9/1994
JP 407088985 4/1995
NL 8204888 7/1984

OTHER PUBLICATIONS

Hearing Testimony, Case No. 09 CV 263 Division 2, Boulder County District Court, Colorado, Apr. 29, 2009, 14 pages.

Hearing Testimony, Case No. 09 CV 263 Division 2, Boulder County District Court, Colorado, Apr. 30, 2009, 35 pages.
Hearing Testimony, Case No. 09 CV 263, Boulder County District Court, Colorado, May 1, 2009, 18 pages.
Hearing Testimony, Case No. 09 CV 263 Division 2, Boulder County District Court, Colorado, May 4, 2009, 27 pages.
Hearing Testimony, Case No. 09 CV 263 Division 2, Boulder County District Court, Colorado, May 5, 2009, 5 pages.
Hearing Testimony, Case No. 09 CV 263 Division 2, Boulder County District Court, Colorado, May 7, 2009, 8 pages.
Hearing Testimony, Case No. 09 CV 263 Division K, Boulder County District Court, Colorado, May 7, 2009, 8 pages.
Operator's Manual for Unisul's Mini-Matic Insulation Blowing Maching, Mfg. by UNISUL, Winter Haven, FL, Publication: RTL 100-08/03, CT0000310-CT0000322, 13 pages.
Attic Protector Blow-In Fiber Glass, Johns Manville International-Insulation Group RIG 1718, Denver, CO, www.jm.com, 08/00-REV, CT0000122-CT0000124, 3 page.
The Cyclone Insulation Blowing Machine, Intec, Frederick, CO, info@inteccorp.com, (Exhibit S), 2 pages.
Blow-Matic 8, Abiff Manufacturing Corp., Denver, CO, www.fiberiffic.com, Copyright 2002-2004 Ark-Seal, LLC, CT0000550-CT0000552, 3 pages.
Tiger II, Hoshall Equipmant, Division of Industrial Gaskel, Inc., Oklahoma City, OK, TWX9108313292 Ind Gasket OKC, CT0000555-CT0000556, 2 pages.
The Force/3 Insulation Blower, Intec, Frederick, CO, http://www.inteccorp.com/Force3.htm-4/14/09, OC002923-OC002925, 3 pages.
The Quantum Insulation Blower, Intec, Frederick, CO, http://www.inteccorp.com/Quantum.htm-4/14/09, OC002930- OC002931, 2 pages.
The Wasp Insulation Blower, Intec, Frederick, CO, http://www.intec-corp.com/Wasp.com-5/18/05, CT0000352- CT0000354, 3 pages.
Krendl #425, Krendl Machining Company, Delphos, OH, www.krendlmachine.com, Copyright Jan. 2009, CT000357-CT000358, 2 pages.
Krendl #250A, Krendl Machining Company, Delphos, OH, www.krendlmachine.com, Copyright Apr. 2008, CT000359- CT000360, 2 pages.
The Force/1, Intec, Frederick, CO, www.inteccorp.com, D200-0200-00, KL REV 3/04, CT0000008-CT0000055, 50 pages.
Insulation Blowers—Accul 9118, Insulation Machine Corp., Springfield, MA, Copyright 2006, http://accuone.com/accul_9118.htm1-Apr. 4, 2009, CT0000056-CT0000057, 2 pages.
AccuOne 9400, AccuOne Industries, Inc., Copyright 1998, http://www.accu1.com/A9400.htm1-7/13/04, CT0000059, 1 page.
Krendl #325, Krendl Machining Company, Delphos, OH, www.krendlmachine.com, CT0000060, 1 page.
Krendl #450A, Krendl Machining Company, Delphos, OH, http://www.krendlmachine.com/products/450a.asp? PartNo=450A-7/13/04, CT0000067-CT0000068, 2 pages.
Cocoon Insulation, Cocoon, Charlotte, NC, Copyright 2003 U.S. Green Fiber, LLC and Copright 2003 by Lowe's, CT0000071-CT0000076, 6 pages.
X-Floc Minifant M99, X-Floc GmbH, Renningen, Germany, Mar. 18, 2009, http://www.x-floc.com/en/machines/minifant-m99.htm1-4/6/09, CT0000449-CT0000451, 3 pages.
X-Floc Zellofant M95, X-Floc GmbH, Renningen, Germany, Feb. 8, 2009, http://www.x-floc.com/en/machines/zellofant-m95.htm1-4/4/09, CT0000107-CT0000112, 6 pages.
Isoblow Mini, Isocell Vertriebs G.M.B.H., Neumarkt Am Wallersee, Austria, www.isocell.at/home-p./blowing-technology/isoblow-mini.html-4/4/09, CT0000436-CT0000438, 3 pages.
Meyer Series 700, "Reliable Hydraulic Power on the Industry's Mot Versatile Platform", Copyright 2007 Wm. W. Meyer & Sons, Inc., Libertyville, IL, www.meyerinsulation.com, CT0000602-CT0000603, 2 pages.
InsulMaxx 1000, Spray Insulation Components, Oklahoma City, OK, http://www.sprayinsulation.com/catalog.asp-1/4/08, CT0000606-CT0000608, 3 pages.
Cocoon-Attic Insulation Blowing Machine, Exhibit II, 2 pages.
U.S. Appl. No. 10/89,9909—Advisory Action May 26, 2009.
U.S. Appl. No. 10/899,909—Response to Final May 12, 2009.
U.S. Appl. No. 10/899,909—Final Rejection Mar. 20, 2009.
U.S. Appl. No. 10/899,909—Rejection Sep. 20, 2007.
U.S. Appl. No. 10/899,909—Rejection Apr. 4, 2008.
U.S. Appl. No. 10/899,909—Response Aug. 27, 2007.
U.S. Appl. No. 10/899,909—Response Dec. 20, 2007.
U.S. Appl. No. 10/899,909—Response May 16, 2008.
U.S. Appl. No. 10/899,909—Response Jan. 7, 2009.
U.S. Appl. No. 10/899,909—Restriction Jul. 31, 2007.
U.S. Appl. No. 11/024,093—3 month office action Mar. 2, 2007.
U.S. Appl. No. 11/024,093—3 month office action Jul. 12, 2007.
U.S. Appl. No. 11/024,093—3 month office action Mar. 5, 2009.
U.S. Appl. No. 11/024,093—Advisory Action Jan. 11, 2008.
U.S. Appl. No. 11/024,093—Final 3 month Oct. 24, 2007.
U.S. Appl. No. 11/024,093—Response Jan. 24, 2007.
U.S. Appl. No. 11/024,093—Response Jun. 4, 2007.
U.S. Appl. No. 11/024,093—Response Oct. 12, 2007.
U.S. Appl. No. 11/024,093—Response Dec. 20, 2007.
U.S. Appl. No. 11/024,093—Response May 28, 2009.
U.S. Appl. No. 11/024,093—Restriction Nov. 24, 2006.
U.S. Appl. No. 11/303,612—3 Month Oct. 15, 2009.
U.S. Appl. No. 11/303,612—Final 3 Month Apr. 30, 2009.
U.S. Appl. No. 11/452,554—3 Month Office Action Apr. 8, 2008.
U.S. Appl. No. 11/452,554—Final 3 Month Oct. 15, 2008.
U.S. Appl. No. 11/452,554—Final 3 Month May 5, 2009.
U.S. Appl. No. 11/452,554—RCE Mar. 11, 2009.
U.S. Appl. No. 11/452,554—Response Jun. 4, 2008.
U.S. Appl. No. 11/452,554—Response After Final Jan. 14, 2009.
U.S. Appl. No. 11/581,660—3 month office May 28, 2009.
U.S. Appl. No. 11/581,661—3 Month Apr. 3, 2008.
U.S. Appl. No. 11/581,661—3 Month May 5, 2009.
U.S. Appl. No. 11/581,661—Advisory Action Jan. 27, 2009.
APSCO—Pneumatic Conveying: Dilute Phase Systems, Dense Phase Systems . . . .
Choosing a pneumatic conveying system . . . ; Powder Bulk Engineering; Steve Grant.
Nonaka-Yasuhiro, Japanese Trade-Journal, Article, Characteristics of Functional Chromium Plating and Its Application 1999.
U.S. Appl. No. 11/303,612—Response Jan. 14, 2009.
U.S. Appl. No. 11/581,661—Response Jul. 17, 2008.
U.S. Appl. No. 11/303,612—Response AF Jun. 29, 2009.
U.S. Appl. No. 11/581,661—Response AF Jan. 9, 2009.
U.S. Appl. No. 11/581,661—Response; RCE Feb. 25, 2009.

* cited by examiner

PARTIALLY CUT LOOSEFILL PACKAGE

TECHNICAL FIELD

This invention relates to loosefill insulation for insulating buildings. More particularly this invention relates to distributing packaged loosefill insulation.

BACKGROUND OF THE INVENTION

In the insulation of buildings, a frequently used insulation product is loosefill insulation. In contrast to the unitary or monolithic structure of insulation batts or blankets, loosefill insulation is a multiplicity of discrete, individual tufts, cubes, flakes or nodules. Loosefill insulation is usually applied to buildings by blowing the insulation into an insulation cavity, such as a wall cavity or an attic of a building. Typically loosefill insulation is made of glass fibers although other mineral fibers, organic fibers, and cellulose fibers can be used.

Loosefill insulation, commonly referred to as blowing insulation, is typically compressed in packages for transport from an insulation manufacturing site to a building that is to be insulated. Typically the packages include compressed blowing insulation encapsulated in a bag. The bags are made of polypropylene or other suitable material. During the packaging of the blowing insulation, it is placed under compression for storage and transportation efficiencies. Typically, the blowing insulation is packaged with a compression ratio of at least about 10:1. The distribution of blowing insulation into an insulation cavity typically uses a blowing insulation distribution machine that feeds the blowing insulation pneumatically through a distribution hose. Blowing insulation distribution machines typically have a large chute or hopper for containing and feeding the blowing insulation after the package is opened and the blowing insulation is allowed to expand.

It would be advantageous if the blowing insulation packages could be improved to make them easier to use.

SUMMARY OF THE INVENTION

The above objects as well as other objects not specifically enumerated are achieved by a package of compressed blowing insulation. The package includes a body of compressed blowing insulation, a bag encapsulating the body of compressed blowing insulation and a slit extending through the package to define a partially divided package.

According to this invention there is also provided a package of compressed blowing insulation comprising a body of compressed blowing insulation, a bag encapsulating the body of compressed blowing insulation and including a plurality of images disposed on the bag, the images including instructions for handling the package, and a slit extending through the package to define a partially divided package.

According to this invention there is also provided a method of blowing insulation from a package of compressed blowing insulation. The method includes providing a package of compressed blowing insulation including a slit partially dividing the package into a pre-cut portion and an un-cut portion, cutting the un-cut portion of the package along a suggested cut line such that the package divides into approximate halves, each half having a bag end and an open end, gripping the bag end of one of the package halves, feeding the open end of the package half into a machine for shredding and picking apart the blowing insulation, and withdrawing the empty bag from the machine.

According to this invention, there is also provided a package of compressed blowing insulation. The package of compressed blowing insulation comprising a plurality of insulation packs, each pack having a body of compressed blowing insulation encapsulated by a sleeve, and a bag encapsulating the plurality of insulation packs.

Various objects and advantages of this invention will become apparent to those skilled in the art from the following detailed description of the preferred embodiment, when read in light of the accompanying drawings.

DETAILED DESCRIPTION OF THE INVENTION

Figure 1:
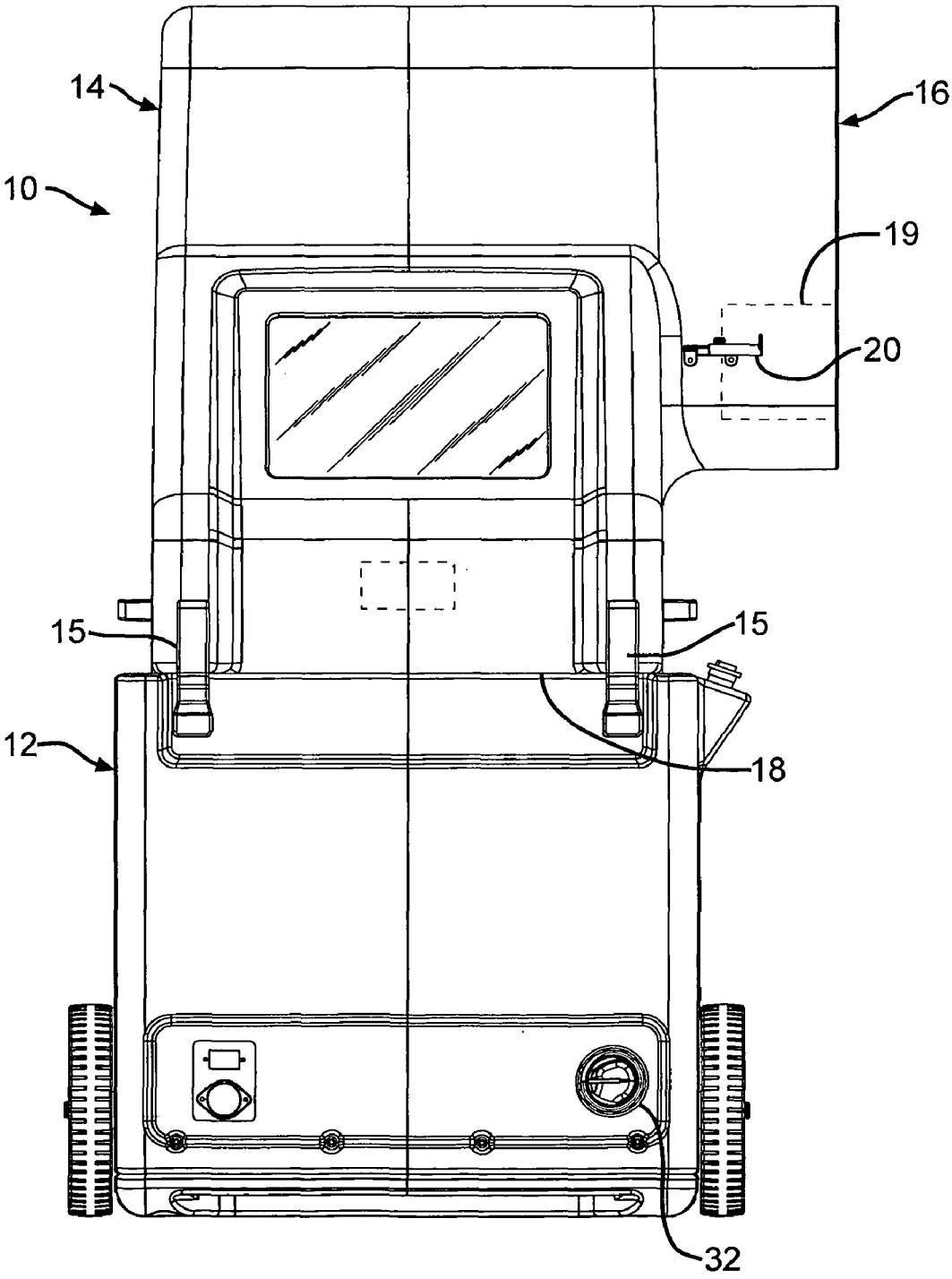
FIG. 1 is a front view in elevation of an insulation blowing machine.
Figure 2:
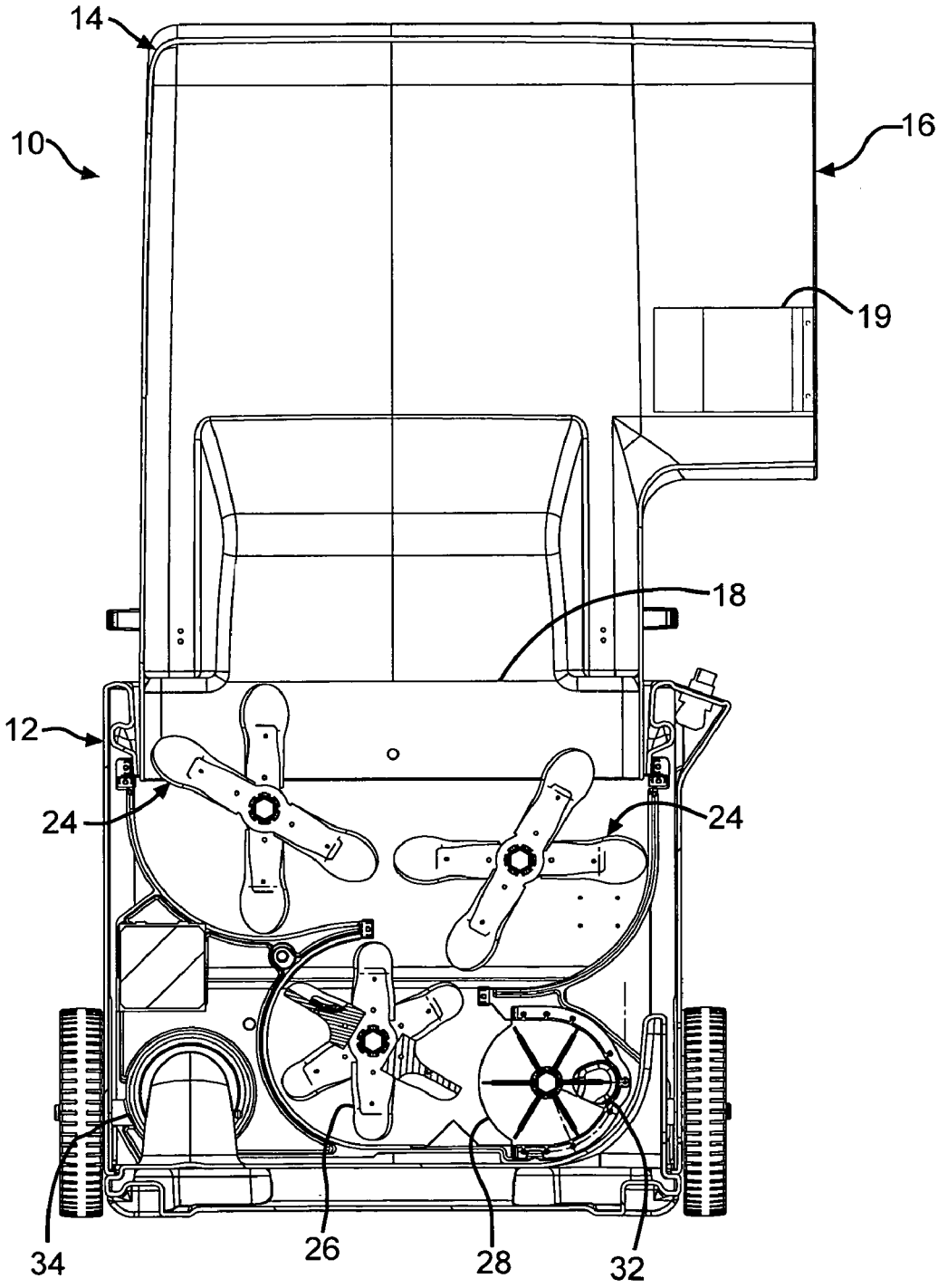
FIG. 2 is a front view in elevation, partially in cross-section, of the insulation blowing machine of FIG. 1.
Figure 3:
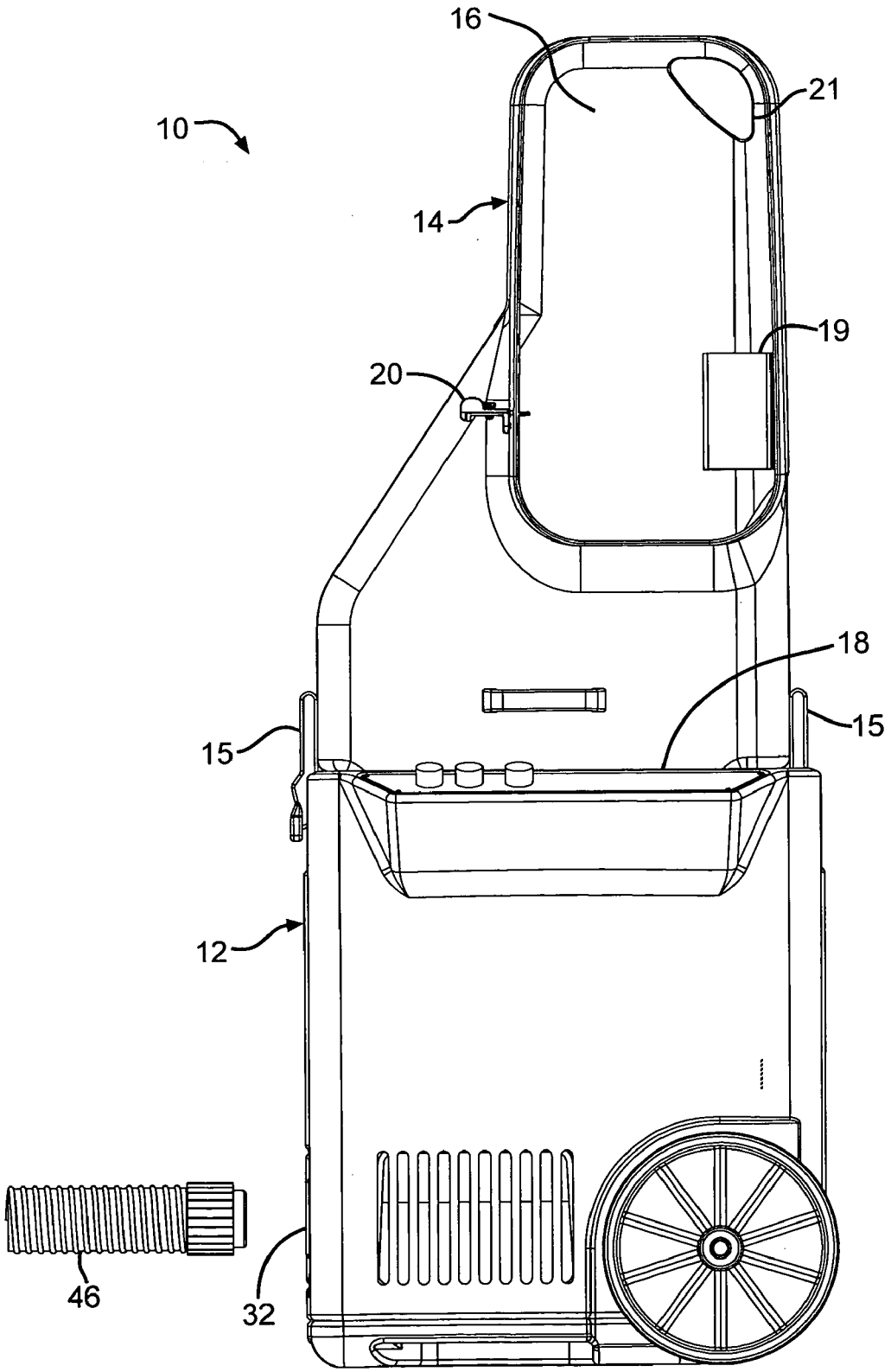
FIG. 3 is a side view in elevation of the insulation blowing machine of FIG. 1.

A blowing insulation machine 10 for distributing compressed blowing insulation is shown in FIGS. 1-3. The blowing insulation machine 10 includes a lower unit 12 and a chute 14. The lower unit 12 is connected to the chute 14 by a plurality of fastening mechanisms 15 configured to readily assemble and disassemble the chute 14 to the lower unit 12. As further shown in FIGS. 1-3, the chute 14 has an inlet end 16 and an outlet end 18.

The chute 14 is configured to receive the blowing insulation and introduce the blowing insulation to the low speed shredders 24 as shown in FIG. 2. Optionally, the chute 14 includes a handle segment 21, as shown in FIG. 3, to facilitate ready movement of the blowing insulation machine 10 from one location to another. However, the handle segment 21 is not necessary to the operation of the machine 10.

As further shown in FIGS. 1-3, the chute 14 includes an optional guide assembly 19 at the inlet end 16 of the chute 14. The guide assembly 19 is configured to urge a package of compressed blowing insulation against a cutting mechanism 20 as the package moves into the chute 14.

As shown in FIG. 2, the low speed shredders 24 are mounted in the lower unit 12 at the outlet end 18 of the chute 14. The low speed shredders 24 are configured to shred and pick apart the blowing insulation as the blowing insulation is discharged from the outlet end 18 of the chute 14 into the lower unit 12. Although the disclosed blowing insulation machine 10 is shown with a plurality of low speed shredders 24, any type of separator, such as a clump breaker, beater bar or any other mechanism that shreds and picks apart the blowing insulation can be used.

As further shown in FIG. 2, an agitator 26 is provided for final shredding of the blowing insulation and for preparing the blowing insulation for distribution into an airstream. A discharge mechanism 28 is positioned downstream from the agitator 26 to distribute the shredded blowing insulation into the airstream. The discharge mechanism 28 can be a rotary valve, or any other mechanism including staging hoppers, metering devices, rotary feeders, sufficient to distribute the shredded blowing insulation into an airstream. The shredded blowing insulation is driven through the discharge mechanism 28 and through a machine outlet 32 by an airstream provided by a blower (not shown) mounted in the lower unit 12.

The shredders 24, agitator 26 and the discharge mechanism 28 are mounted for rotation. They can be driven by any suitable means, such as by a motor 34, or any other means sufficient to drive rotary equipment. Alternatively, each of the shredders 24, agitator 26, and discharge mechanism 28 can be provided with its own motor.

In general, the chute 14 guides the blowing insulation to the low speed shredders 24 which shred and pick apart the blowing insulation. The shredded blowing insulation drops from the low speed shredders 24 into the agitator 26. The agitator 26 prepares the blowing insulation for distribution into an airstream by further shredding the blowing insulation. The finely shredded blowing insulation drops from the agitator 26 into the discharge mechanism 28 for distribution into the airstream caused by the blower. The airstream, with the shredded blowing insulation, exits the machine 10 at the machine outlet 32 and flows through a distribution hose 46, as shown in FIG. 3, toward the insulation cavity, not shown.

In one embodiment as shown in FIG. 3, the chute 14 has a substantially rectangular cross-sectional shape that approximates the substantially rectangular cross-sectional shape of a package 70 of compressed blowing insulation. In one embodiment, the package 70 has a height of about 8 inches, a width of about 19 inches and a length of about 38 inches. Such a package 70 might have a weight of about 35 pounds, although the package 70 can weigh more or less than 35 pounds. In this embodiment, the chute 14 has a substantially rectangular cross-section shape of about 9 inches by 20 inches. The substantially rectangular cross-sectional shape of the chute 14 allows the package 70 to be easily received and fed through the chute 14 and to be engaged by the low speed shredders 24.

Figure 4:
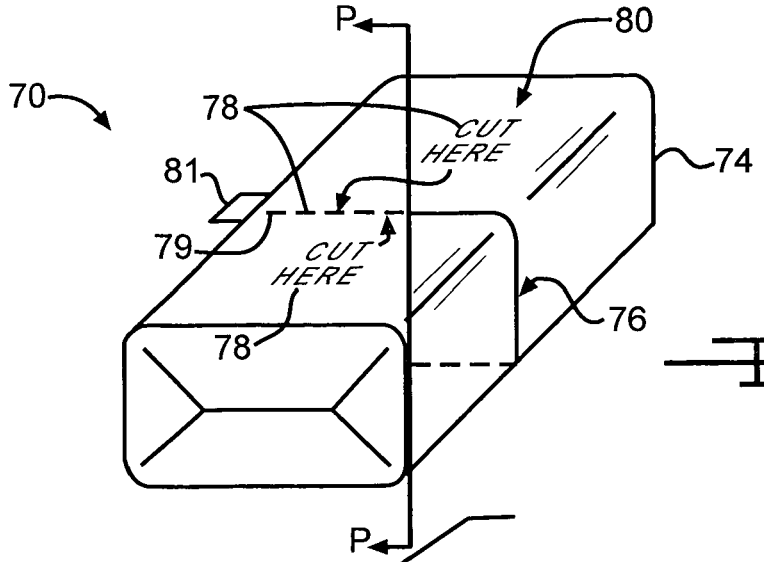
FIG. 4 is a perspective view of a package of compressed blowing insulation.

As shown in FIG. 4, the package 70 of compressed blowing insulation includes a bag 74 that encapsulates a body of compressed blowing insulation. The bag 74 is made of a polymeric material, such as polyethylene, although any type of material suitable for maintaining the blowing insulation in the desired compression can be used. The bag 74 provides a waterproof barrier against water, dirt and other deleterious effects. By using a polymeric material for the bag 74, the compressed blowing insulation will be protected from the elements during transportation and storage of the package 70.

The compressed blowing insulation in the package 70 can be any loosefill insulation, such as a multiplicity of discrete, individual tuffs, cubes, flakes, or nodules. The blowing insulation can be made of glass fibers or other mineral fibers, and can also be organic fibers or cellulose fibers. Typically, the loosefill insulation is made of glass fibers although other insulation materials such as rock wool, mineral fibers, organic fibers, polymer fibers, inorganic material, and cellulose fibers. Other particulate matter, such as particles of foam, may also be used. Combinations of any of the aforementioned materials are another alternative.

The blowing insulation can have a binder material applied to it, or it can be binderless. The blowing insulation in the package 70 is compressed to a compression ratio of at least 10:1, which means that the unconstrained blowing insulation, after the bag 74 is opened, has a volume of 10 times that of the compressed blowing insulation in the bag 74. Other compression ratios higher or lower than 10:1 can be used.

Figure 5:
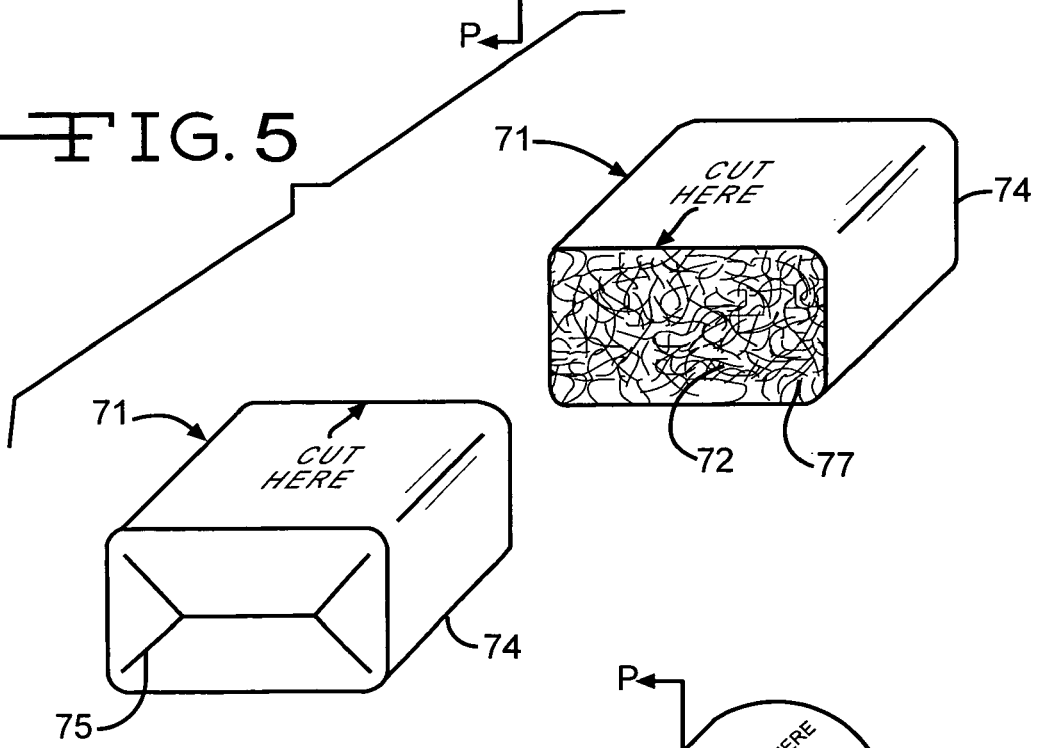
FIG. 5 is a perspective view of half packages of compressed blowing insulation.

In one embodiment as shown in FIG. 4, the package 70 includes a body of the compressed blowing insulation encapsulated by a bag 74. A slit 76 extends through the body of compressed blowing insulation and the bag 74 and partially divides the package 70. In one embodiment, the slit 76 is disposed along the length of the package 70 such that the slit divides the package 70 into approximately equal size half packages 71 as shown in FIG. 5. In another embodiment, the package 70 can include multiple slits positioned along the length of the package 70. In this embodiment, the slits divide the package 70 into multiple package segments (not shown). For example, a package 70 having three slits would be divided into four package segments. Each package segment includes a body of compressed blowing insulation encapsulated by the bag 74. Each package segment is capable is being fed into the blowing insulation machine 10.

As further shown in FIGS. 4 and 5, the slit 76 is configured to be substantially perpendicular to the length of the package 70. A substantially perpendicular slit 76 enables the machine user to readily cut the un-cut portion of the package 70 along a suggested cut line 79. Cutting the package 70 along the suggested cut line 79 ensures that the resulting half packages 71 are capable of being readily fed into the machine 10. However, it should be understood that the slit 76 can be an angled relative to the length of the package 70 and that the angle of the slit 76 relative to the length of the package 70 is not important to the operation of the package 70.

In this embodiment, the package 70 has a length and width which define a major face 80 of the package 70 as shown in FIG. 4. The slit 76 is positioned along the width of the major face 80 and extends approximately one-half of the width of the package 70. Alternatively, the slit 76 can extend any width of the package 70, up to a maximum of ⅞ of the width of the package 70.

The slit 76 enables the machine user to divide the package 70 into half packages 71 by cutting the package 70 along a suggested cut line 79 as shown in FIGS. 4 and 5. As shown in FIG. 4, the suggested cut line 79 is defined as the un-cut portion of the package 70 taken along a Plane P defined by the slit 76. In one embodiment, the machine user cuts the package 70 along the suggested cut line 79 with a knife. In another embodiment, the machine user cuts the package 70 along the suggested cut line 79 with cutting shears, or any other cutting tool sufficient to divide the package 70 along the suggested cut line 79.

In this embodiment as further shown in FIG. 4, the package 70 incorporating the slit 76 is delivered to the machine user without a protective covering over the slit 76. Alternatively, the package 70 may include a protective covering 81 to protect the body 72 of blowing insulation from dirt, water and other foreign contaminants during the period of time in which the package 70 is in storage or delivery. The protective covering 81 could be a see-through film, or any other covering sufficient to protect the package 70 from foreign contamination.

In one embodiment as shown in FIG. 4, the package 70 includes a plurality of images 78 disposed on the bag 74. The images 78 are disposed on the bag 74 by various methods including printing on the bag or by stickers disposed on the bag 74 or by any other method sufficient to dispose images on the bag 74. The images 78 include instructions to the machine user for cutting the package 70 along the suggested cut line 79, or cutting the package 70 in another package 70 location. In another embodiment, the images 78 include instructions informing the machine user on feeding the half-packages 71 into the machine 10. In yet another embodiment, the images 78 include instructions to the machine user for disposal of the bag 74 after the body 72 of blowing insulation has been fed into the chute 14. In another embodiment, the plurality of images 78 include safety messages or warnings to the machine user.

Figure 6:
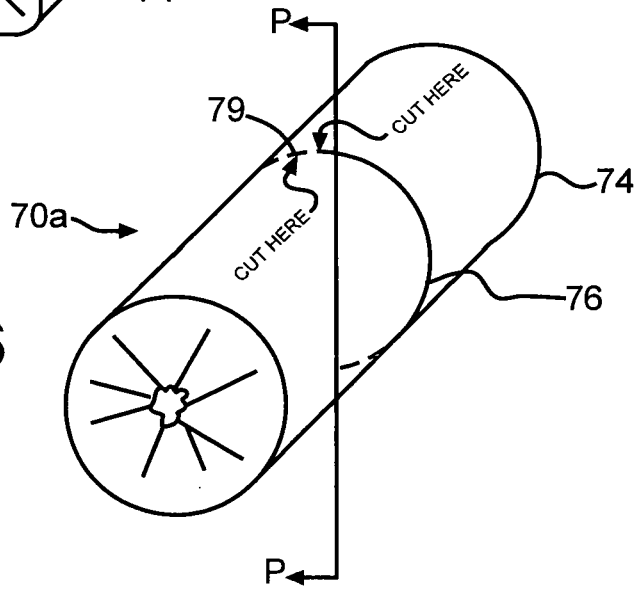
FIG. 6 is a perspective view of an alternate embodiment of a package of blowing insulation having a round cross-sectional shape.

As previously discussed and as shown in FIG. 3, the chute 14 has a substantially rectangular cross-sectional shape that approximates the substantially cross-sectional shape of the package 70. In another embodiment, the chute 14 may have a round cross-sectional shape that approximates the cross-sectional shape of a package 70*a* of blowing insulation in roll form, as shown in FIG. 6. In this embodiment, the slit 76 extends into the package 70*a* to extent of one-half of the diameter of the package 70*a* and is disposed to be substantially perpendicular to the length of the package 70*a* as defined by slit plane P. As discussed previously, the slit 76 enables the machine user to readily cut the package 70*a* along the suggested cut line 79 thereby forming half packages.

In general operation, packages 70 of compressed blowing insulation are provided to the machine user. The packages 70 include a slit 76 which partially divides the package into pre-cut and un-cut portions. Images 78 provided on the package 70 to instruct the machine user on the location of the final cutting of the package 70 and optionally, the images 78 provide a suggested cut line 79. The machine user cuts the un-cut portion of the package 70 along the optional suggested cut line 79 which divides the package 70 into approximate half packages 71. Each half package 71 includes a bag end 75 and an open end 77 as shown in FIG. 5. The machine user grips the bag end 75 of the half package 71 and feeds the open end 77 of the half package 71 into the chute 14 of the blowing insulation machine 10. The machine user continues gripping the bag end 75 as the blowing insulation 72 is fed into the chute 14. After the blowing insulation 72 has been fed into the chute 14, the machine user withdraws the empty bag 74 from the machine 10.

Figure 7:
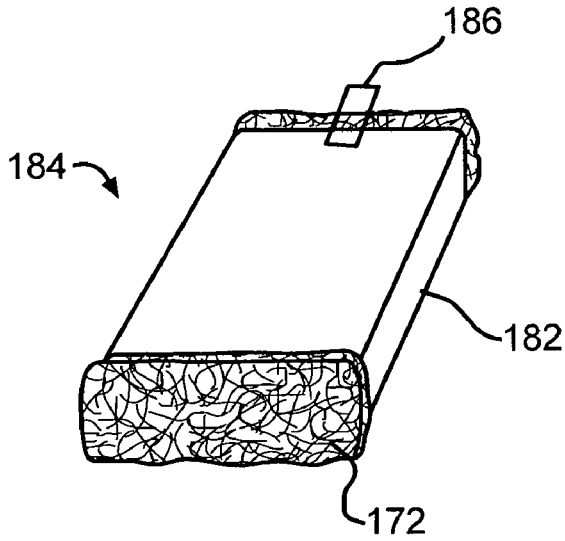
FIG. 7 is a perspective view of an insulation pack.

In another embodiment as shown in FIG. 7, the body 172 of blowing insulation is encapsulated in a sleeve 182 to form an insulation pack 184. The sleeve 182 is made of a polymeric material, such as polyethylene, although any type of material suitable for maintaining the blowing insulation in the desired compression can be used. While the sleeve 182 shown in FIG. 7 is a one piece member, the sleeve 182 is defined to be any material or structure, such as bands, film or glue, sufficient to maintain the body 172 of blowing insulation in the desired compression.

An optional gripping tab 186 is connected to the sleeve 182 and extends past the end of the sleeve 182. The gripping tab 186 is gripped by the machine user as the insulation pack 184 is fed into the chute 14 and allows the machine user to easily retain the sleeve 182 after the blowing insulation has been fed into the machine 10. While a single gripping tab 186 is shown in FIG. 7, it should be understood that more than one gripping tab 186 may be connected to the sleeve 182. The gripping tab 186 can be any material, such as plastic, sufficient to be gripped by the machine user and retain the sleeve 182 as the insulation pack 184 is fed into the machine 10.

Figure 8:
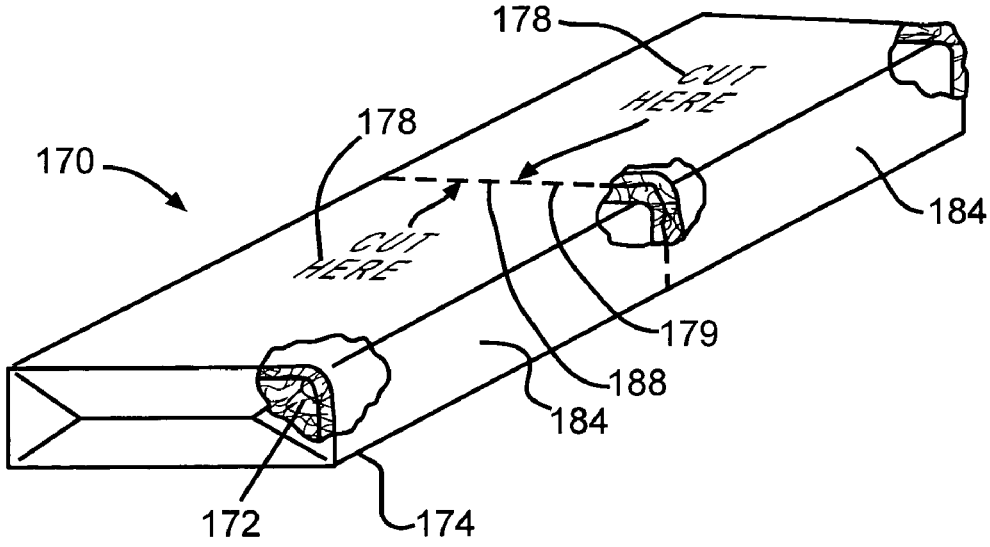
FIG. 8 is a perspective view of a package of blowing insulation having insulation packs assembled end-to-end and encapsulated by a bag.
Figure 9:
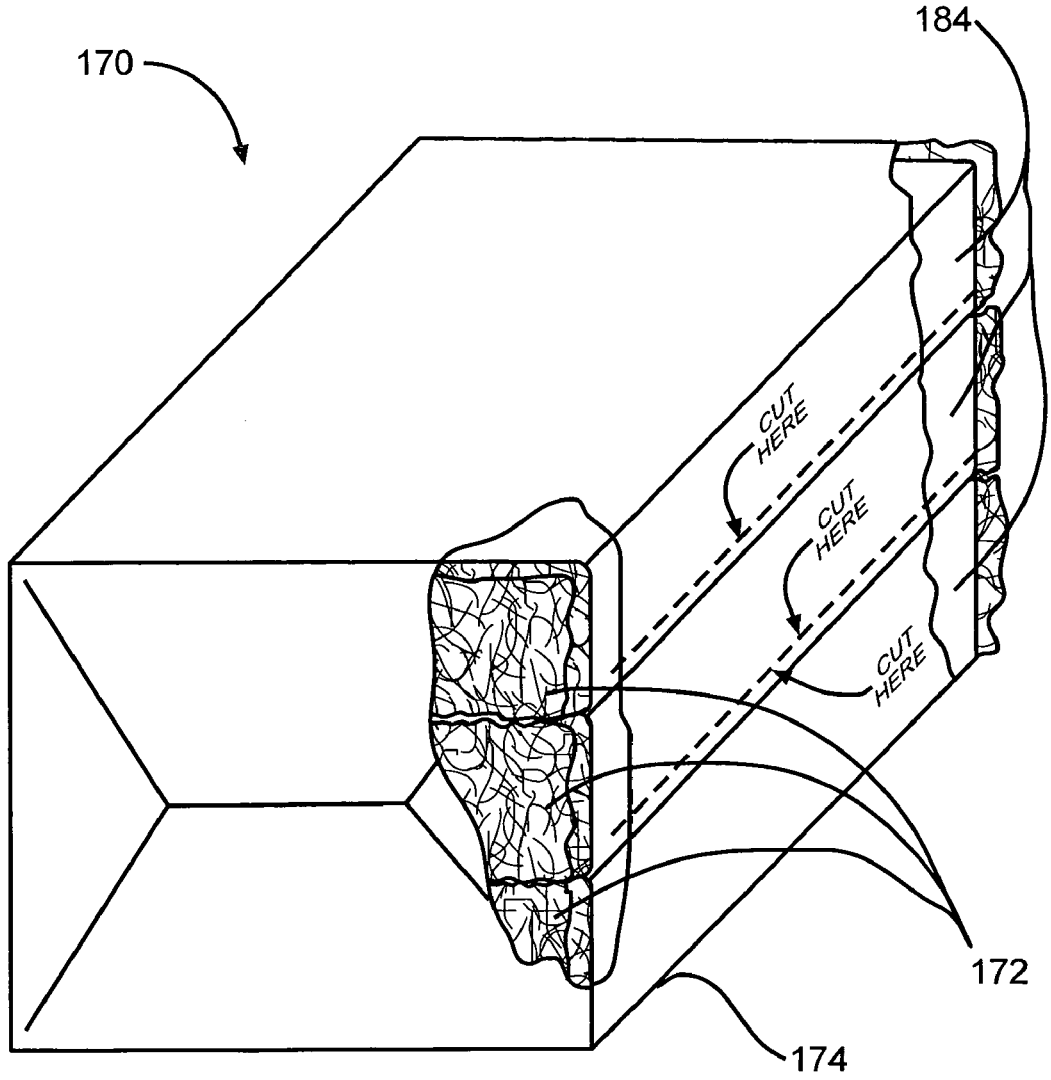
FIG. 9 is a perspective view of an alternate package of blowing insulation having insulation packs assembled by stacking and encapsulated by a bag.

As shown in FIG. 8, at least two insulation packs 184 can be assembled together end-to-end. The end-to-end insulation packs 184 are encapsulated with a bag 174 to form a package 170. As discussed previously, the bag 174 can be any material, such as a polymeric material, suitable to provide a waterproof barrier against water, dirt and other deleterious effects. By using a polymeric material for the bag 174, the compressed blowing insulation will be protected from the elements during transportation and storage of the package 170. As shown in FIG. 8, the insulation packs 184 can be assembled together end-to-end and encapsulated by the bag 174. In another embodiment, the insulation packs 184 can be stacked as shown in FIG. 9 and encapsulated by the bag 174 or assembled together in any other manner to provide a convenient package 170.

In one embodiment as shown in FIG. 8, the package 170 can include a plurality of images 178 disposed on the bag 174. The images 178 can be disposed on the bag 74 in a manner similar to that previously discussed. The images 178 can include suggested cut lines 179 and instructions to the machine user for opening the package 170 or instructions for loading the insulation packs 184 into the machine 10.

In general operation of this embodiment, packages 170 are provided to the machine user. The packages 170 include images 178 provided on the package 170 instructing the machine user on opening of the package 170. Optionally, the images 178 provide a suggested cut line 179 for opening the package 170. As an additional option, the package 170 may include perforations 188 enabling the machine user to readily open the package 170. The machine user opens the package 170 at the prescribed opening locations by cutting the package 170 or by the opening method provided by the images 178. The machine user grips an insulation pack 184 by the optional gripping tabs 186 and feeds the insulation pack 184 into the chute 14 of the blowing insulation machine 10. The machine user continues gripping the gripping tabs 186 as the blowing insulation 172 is fed into the chute 14. After the blowing insulation 172 has been fed into the chute 14, the machine user withdraws the empty sleeve 182 from the machine 10.

The principle and mode of operation of this blowing insulation machine have been described in its preferred embodiments. However, it should be noted that the blowing insulation machine may be practiced otherwise than as specifically illustrated and described without departing from its scope.

What is claimed is:

1. A package of compressed blowing wool comprising:

a body of compressed blowing wool; and a bag encapsulating the body of compressed blowing wool;

wherein the package has a slit extending through the body of compressed blowing wool and the bag, the slit defining a partially divided package.

2. The package of claim 1 having a width, height and length, wherein the package has a substantially rectangular cross-sectional shape across the width of the package.

3. The package of claim 1 having a width, height and length, wherein the slit is substantially perpendicular to the length of the package.

4. The package of claim 1 having a width, height and length, wherein the slit extends approximately one-half of the width of the package.

5. The package of claim 1 having a width, height and length, wherein the slit is positioned along approximately one-half of the length of the package, wherein the slit partially divides the package in approximately two equal halves.

6. The package of claim 1 having a width, height and length, wherein the package has more than one slit positioned along the length of the package.

7. The package of claim 1, wherein the slit is covered by a protective film.

8. The partially divided package of claim 1 having an un-cut portion, wherein the un-cut portion along the suggested cut line is capable of being cut with a knife.

9. The package of claim 1, wherein the body of compressed blowing wool has a compression ratio of at least 10:1.

10. A package of compressed blowing wool comprising:

a body of compressed blowing wool; and a bag encapsulating the body of compressed blowing wool, the bag including a plurality of images disposed on the bag, the images including instructions for handling the package;

wherein the package has a slit extending through the body of compressed blowing wool and the bag, the slit defining a partially divided package.

11. The package of claim 10 in which the plurality of images on the bag includes instructions for disposal of the bag.

12. The package of claim 10 in which the plurality of images on the bag includes a suggested cutting line.

13. The package of claim 10 in which the plurality of images are printed on the bag.

* * * * *